US007232947B1

(12) United States Patent
Lombardi

(10) Patent No.: US 7,232,947 B1
(45) Date of Patent: Jun. 19, 2007

(54) ELONGATED LINKAGE CONNECTED PEDAL UNIT AND CYMBALS APPARATUS

(75) Inventor: Donald G. Lombardi, Westlake Village, CA (US)

(73) Assignee: Drum Workshop, Inc., Oxnard, CA (US)

( * ) Notice: Subject to any disclaimer, the term of this patent is extended or adjusted under 35 U.S.C. 154(b) by 83 days.

(21) Appl. No.: 11/036,876

(22) Filed: Jan. 18, 2005

(51) Int. Cl.
*G10D 13/02* (2006.01)

(52) U.S. Cl. ..... 84/422.2; 84/327

(58) Field of Classification Search ..... 84/422.2, 84/422.1, 422.3, 327; D17/22
See application file for complete search history.

(56) References Cited

U.S. PATENT DOCUMENTS 3,747,464 A * 7/1973 Russell ..... 84/422.1
4,538,499 A * 9/1985 Livingston ..... 84/422.1
4,747,333 A * 5/1988 Hoshino ..... 84/422.1
5,267,500 A * 12/1993 Lombardi ..... 84/402
5,789,688 A * 8/1998 Schiano ..... 84/422.1
5,990,401 A * 11/1999 Braun et al. ..... 84/422.1
6,476,300 B1 * 11/2002 Kurosaki ..... 84/327
2005/0150355 A1 * 7/2005 Sutej ..... 84/422.3

* cited by examiner

*Primary Examiner*—Lincoln Donovan
*Assistant Examiner*—Jianchun Qin
(74) *Attorney, Agent, or Firm*—William W. Haefliger

(57) ABSTRACT

For use in actuating a cymbal or the like, there being an upright support stand and an upright rod associated with the stand and attached to the cymbal to move it vertically, and there being a foot activated pedal unit remote from the stand, the combination comprising a first frame associated with the stand, and a connector unit associated with the frame, said rod connected with said connector unit to be moved longitudinally upwardly and downwardly by said unit, an elongated rotary linkage extending laterally between said pedal unit and said connector unit, the connector unit configured to convert rotary motion transmitted by the linkage to longitudinal motion transferred to said rod.

8 Claims, 6 Drawing Sheets

ELONGATED LINKAGE CONNECTED PEDAL UNIT AND CYMBALS APPARATUS

BACKGROUND OF THE INVENTION

This invention relates generally to operation of percussion equipment, and more particularly to use of foot activated pedal unit or units to control operation of cymbals, at a location or locations spaced at selected distance from the pedal unit or units. More particularly, it concerns provision of a rotary linkage to transmit motion of a pedal at a pedal unit to a remotely located cymbals disc, without need for a flexible cable, as in U.S. Pat. No. 5,267,500.

There is need for improvements in foot pedal control of cymbal apparatus, whereby use of a flexible cable motion transmission means is eliminated. Such cables introduce unwanted friction or drag in the mechanical motion transmission to the remote cymbal apparatus, and are also ungainly in a percussion instrument performance set-up. Also, there is need for low friction, tight, rotary coupling, between the pedal unit and the cymbals apparatus, to eliminate need for sliding, flexible cable endwise connection in such apparatus, and wherein a return spring is employed at the cymbal stand, in the motion coupling relation to the foot pedal unit.

SUMMARY OF THE INVENTION

It is a major object of the invention to provide a solution to the difficulties and problems referred to. In this regards the invention concerns apparatus for use in actuating a cymbal or the like, there being an upright support stand and an upright rod associated with the stand and attached to a cymbals disc, to move it vertically, and there being a foot activated pedal unit remote from the stand, together with:

a) a first frame associated with the stand, and a connector unit associated with the frame, said rod connected with the connector unit to be moved longitudinally upwardly and downwardly by the connector unit, b) an elongated rotary linkage extending laterally between the pedal unit and the connector unit, the connector unit configured to transfer rotary motion transmitted by the linkage to longitudinal motion transmitted to the rod.

As will be seen, the connector unit may include a rotor having an axis of rotation, the linkage connected to the rotor to rotate the rotor about its axis, and a transmission displaced endwise by the rotor to displace the rod upwardly and downwardly in response to rotor rotation. The rotor may for example comprise a sprocket, and the transmission may comprise a chain connected between the sprocket and rod.

A further object is to provide support structure supporting a portion of said linkage, at a location between the first frame and the pedal unit. The support structure may comprise a drum, such as a bass drum having a rim to support the linkage, for rotation. The linkage may comprise multiple links, a first link supported by said support structure. A second link may then be connected between the pedal unit and the first link; and a third link connected between said connector unit and said first link. Typically, the first link is elevated above the level of a beater for the base drum. To compensate for any misalignments, universal joints may be connected between the links, as will appear.

Yet another object includes the provision of a return spring acting via the rotary linkage to yieldably resist downward movement of the pedal at the pedal unit. That return spring may typically be located at the cymbal stand to resist endwise vertical displacement of the rod in a direction to clash the cymbals, and to transmit motion to the sprocket at the stand.

The method of use of the apparatus includes providing and employing at least one universal joint in series with the described linkage to compensate for misalignment between the pedal unit and connector unit.

The method also includes providing a percussion instrument in the space between the pedal unit and the connector unit, the linkage by-passing beater for said percussion instrument. The linkage may include an elevated middle link supported by a drum rim, and two additional links, one of which is connected between the pedal unit and said middle link, and the other of which is connected between said middle link and said connector unit.

These and other objects and advantages of the invention, as well as the details of an illustrative embodiment, will be more fully understood from the following specification and drawings, in which:

DRAWING DECRYPTION

DETAILED DESCRIPTION

Figure 1:
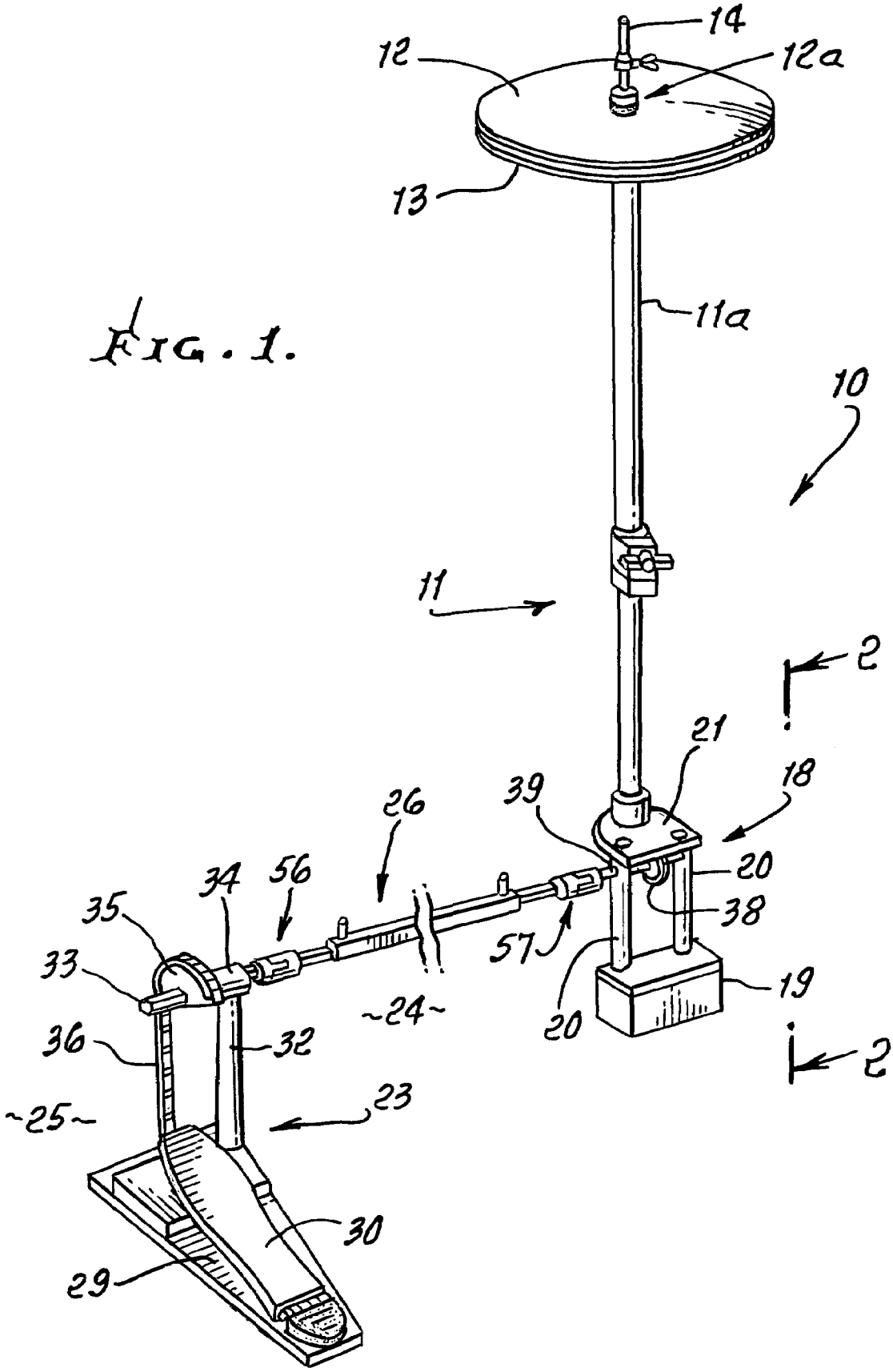
FIG. 1 is a perspective view showing a preferred form of the invention.

In FIG. 1, a cymbal apparatus 10 includes an upright support stand 11, and upper and lower cymbals discs 12 and 13 at the upper end of the stand. An upright rod 14 is associated with the stand and attached at 12*a* to the upper disc 12 to move it vertically, for clashing with the lower disc 13. The rod is movable endwise within outer sleeve 11*a* of the stand, that sleeve being supported at its lower end by a support frame 18. Merely as illustrative, frame 18 includes a base 19, two pedestals or uprights 20, and a crosspiece 21 supporting sleeve 11*a*. Base 19 may be of selected size, for balance.

A foot activated pedal unit 23 is positioned at a distance from the stand 11 and the frame 18, whereby percussion or other equipment can be located within space 24 between 18 and 23, and/or at the opposite side 25 of the unit 23. Accordingly, the drummer need not be positioned close to the cymbals stand 11 in order to operate the cymbals discs, since a laterally elongated rotary linkage 26 is provided to traverse space 24, and is operatively connected to the pedal unit 23 and to the rod 14.

Pedal unit 23 includes a base 29, a foot operated pedal 30 hingedly connected at 31 to the base, an upright or pedestal 32, a laterally extending axle 33 that is bearing supported at 34 by the pedestal, a sprocket 35 on the axle, and a drive chain 36 connected to the forward end of the pedal, and extending upwardly to entrain the sprocket. As the pedal is pushed down, the sprocket 35 rotates the axle and the linkage 26. The linkage rotates a sprocket 38 on an axle 39 that extends between the pedestals 20. A motion transfer means such as a chain 40 entraining the sprocket 38 is driven endwise to move the rod 14 downwardly, acting to clash the cymbals disc.

Figure 2:
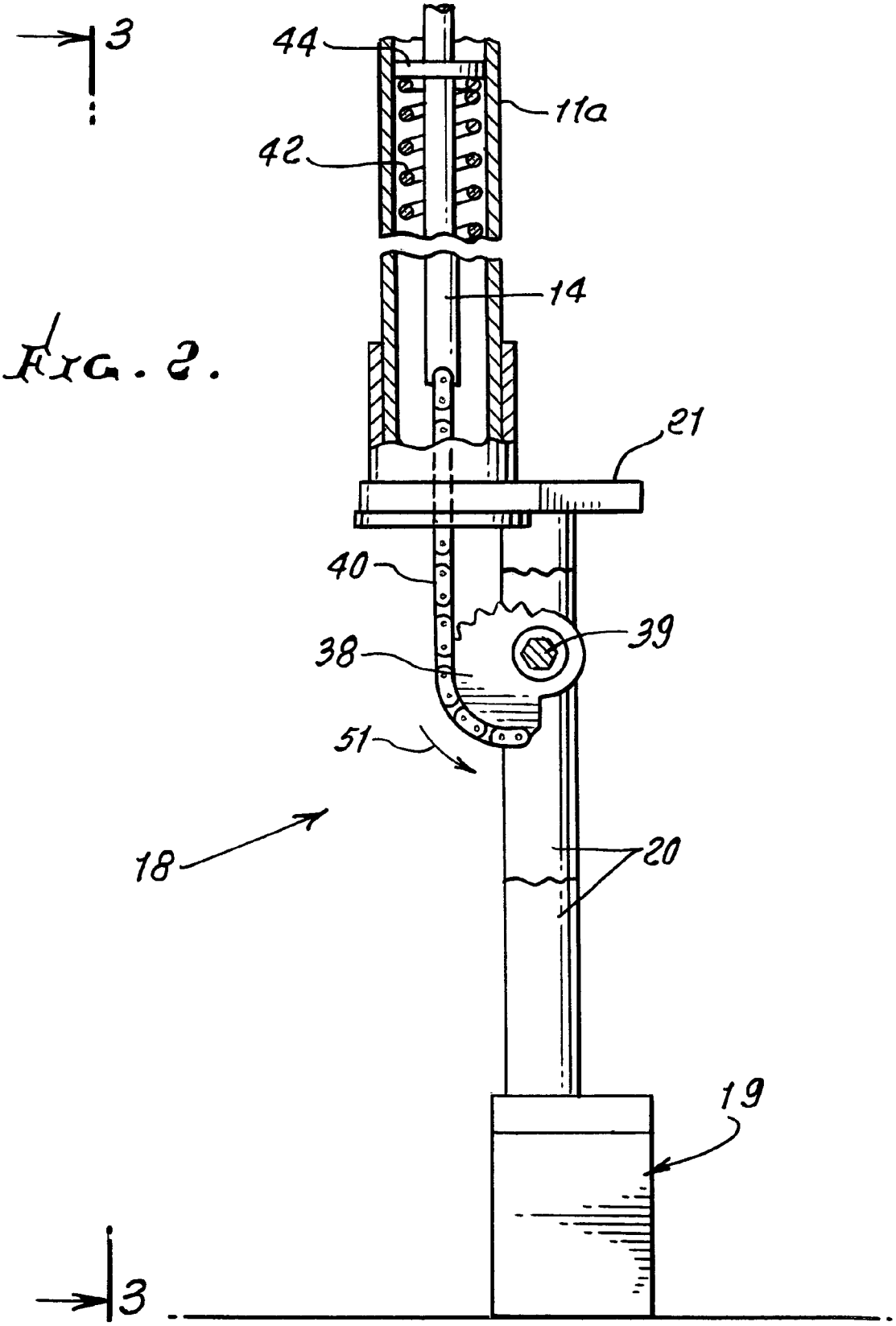
FIG. 2 is an enlarged elevation, partly broken away, and taken on lines 2—2 of FIG. 1.
Figures 3, 4:
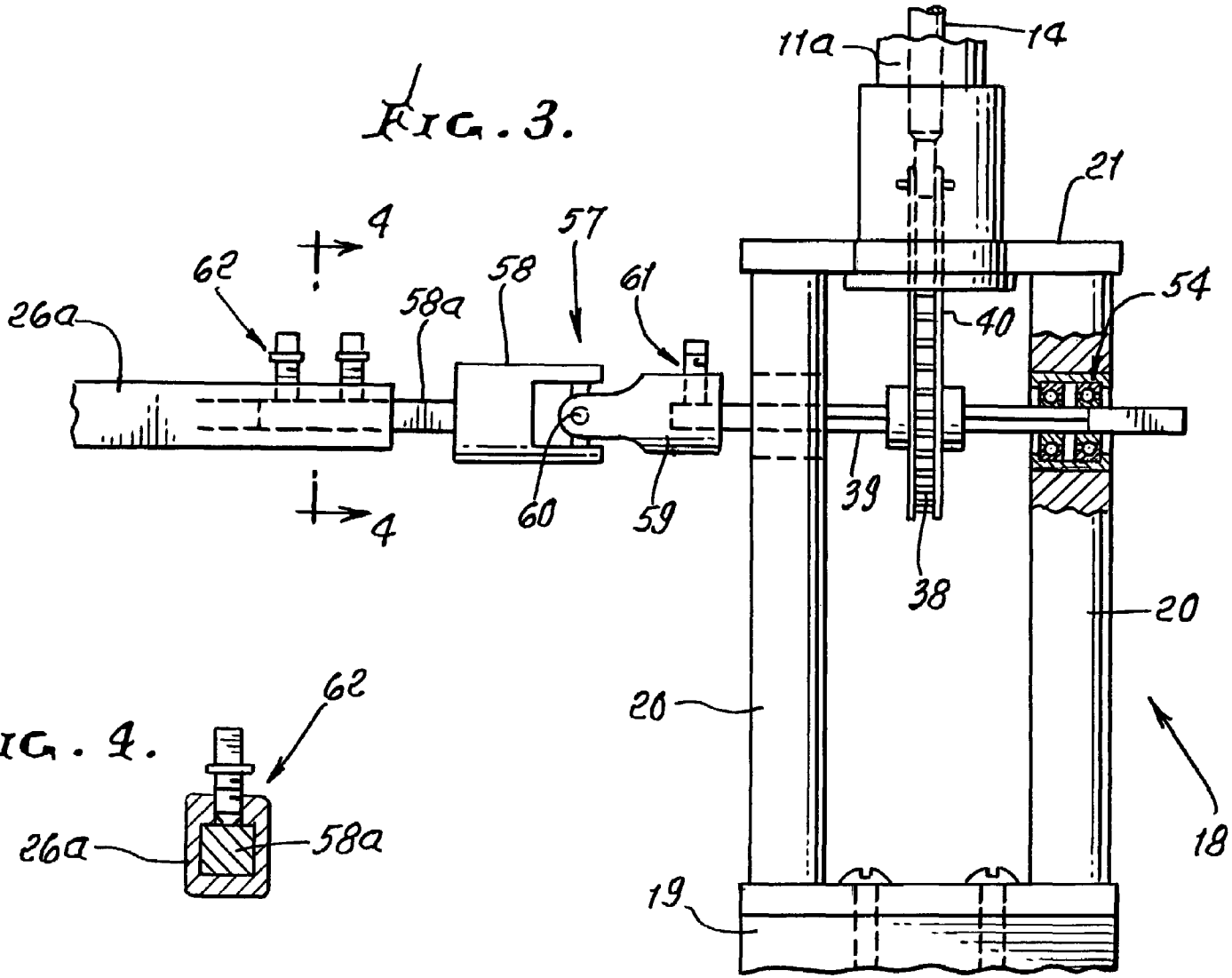
FIG. 3 is an elevation taken on lines 3—3 of FIG. 2.
FIG. 4 is an enlarged cross section taken on lines 4—4 of FIG. 3.

FIG. 2 also shows a return compression spring 42 within the sleeve 11*a* acting against a plunger or other shoulder 44 on the rod tending to urge the rod upwardly and lift disc 12 after foot pressure on the pedal is relieved. Arrow 51 shows the direction of sprocket 38 rotation in response to downward foot pressure on the pedal, acting to depress rod 14. FIG. 3 shows provision of bearings 54 in up right 20 for the axle or shaft 39, whereby a very low-friction tight rotary coupling is provided between axle 33 and axle 39.

Linkage 26 is shown to preferably include two universal joints 56 and 57 at opposite ends of a laterally elongated leakage bar member or extension 26*a*. As seen in FIG. 3, each joint includes two rotary members 58 and 59 pivotally interconnected at 60, for universal directional pivoting. In FIG. 3, member 59 is clamp connected at 61 to axle 39, and member 58 has an extension 58*a* clamp connected at 62 to the rightward end of extension 26*a*. Similar joint structure is provided at universal joint 56, for connection to axle 33 and to the leftward end of elongated extension 26*a*. This enables rapid replacement of extension 26*a* with longer or shorter extensions, as needed, for expanding or contracting space 24, as seen in FIG. 1.

Figure 5:
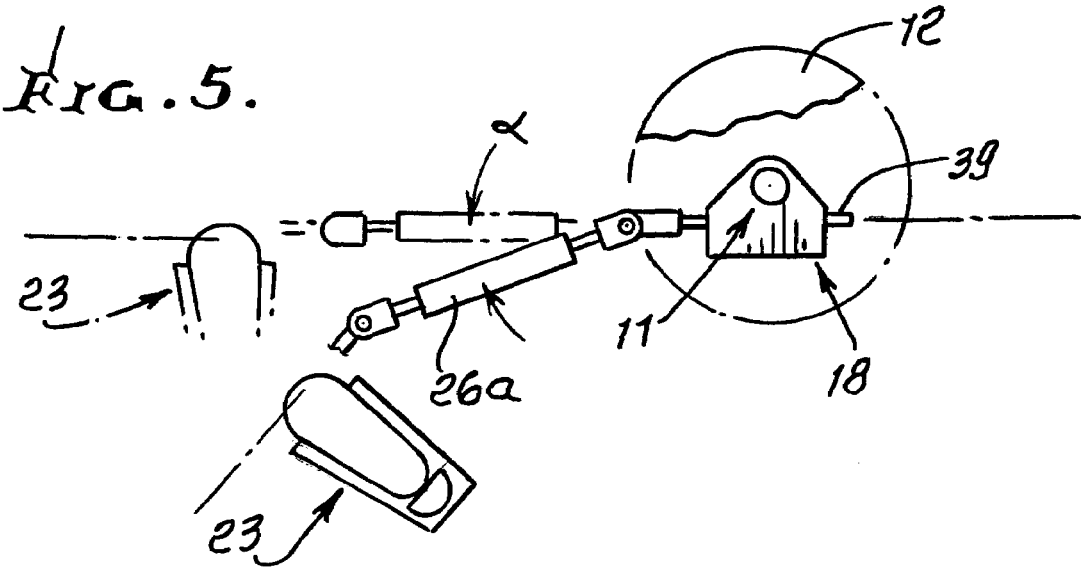
FIGS. 5–7 are views showing various installation configurations enabled by the invention.
Figure 6:
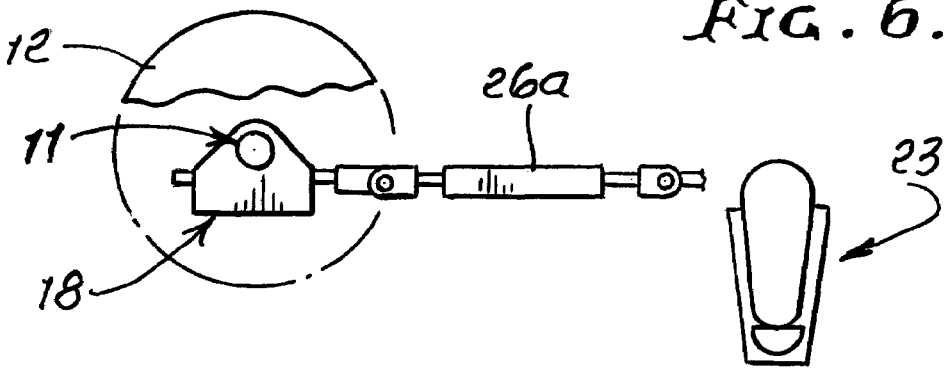
Figure 7:
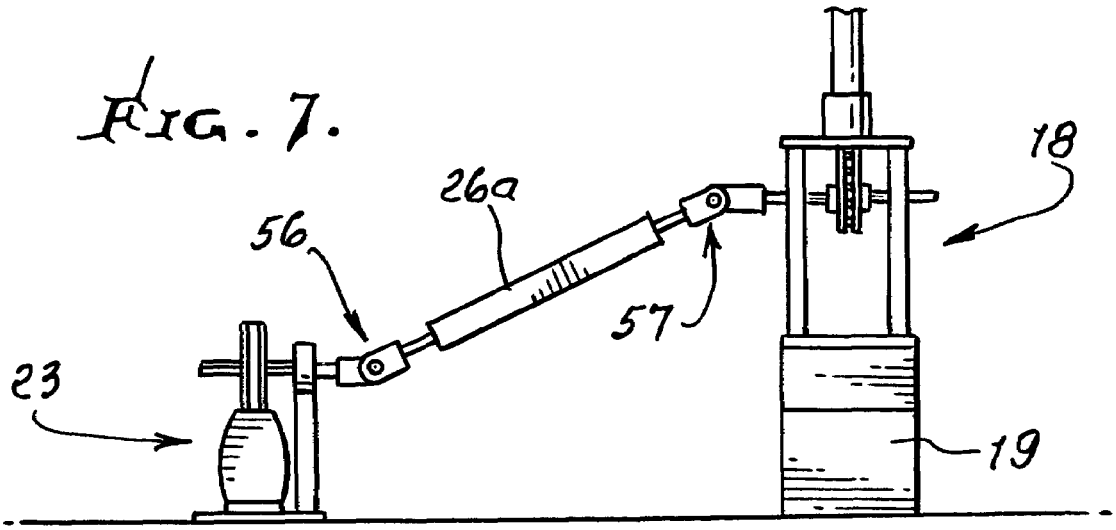

See also the set-up adjustments made possible in FIGS. 5–7. In FIG. 5, the extension 26*a* is swung at an angle $\alpha$ relative to the axis of axle 39; in FIG. 6 the cymbals stand is placed at the opposite side of the pedal unit; and in FIG. 7 cymbals frame 18 is elevated relative to the pedal unit, as by increased height of 19, as is enabled by the universal joints, 56 and 57.

Figure 8:
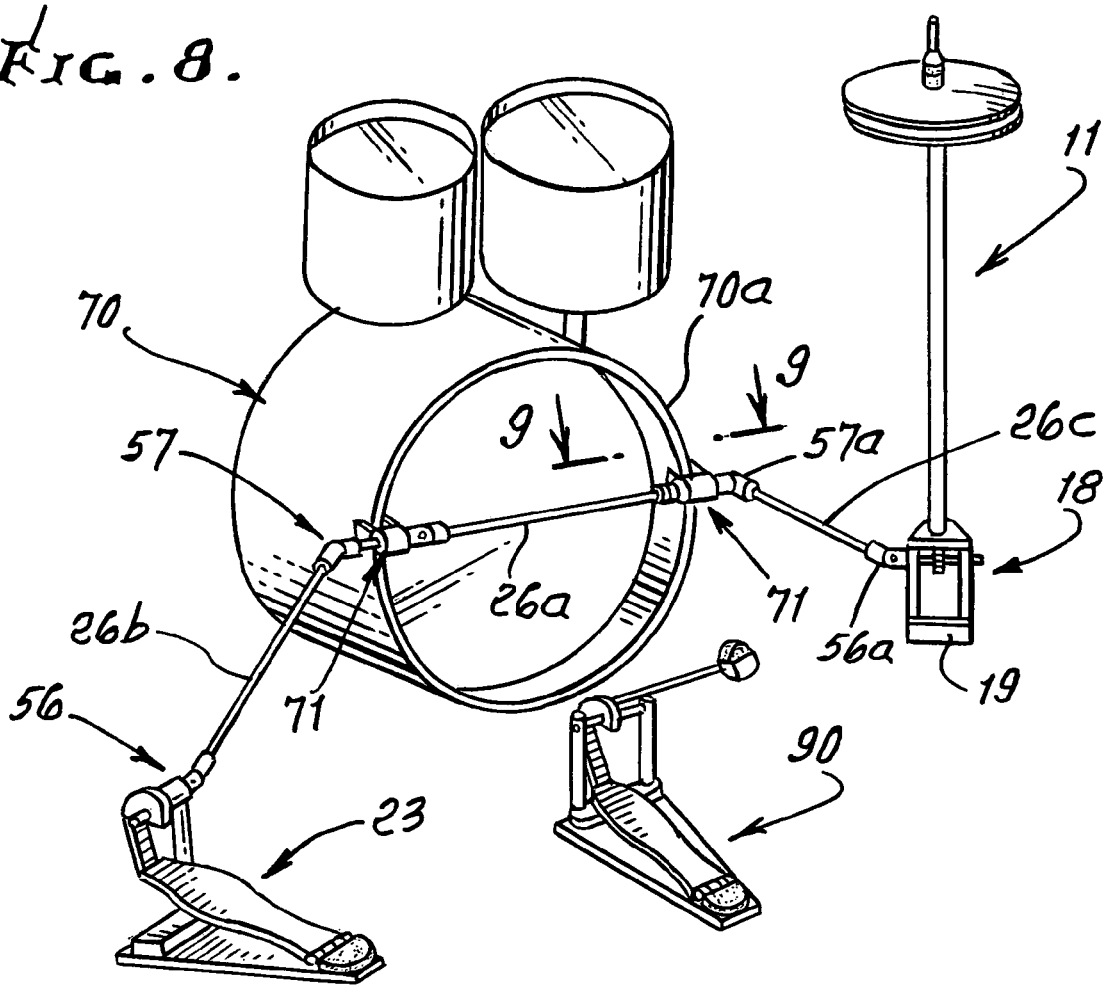
FIG. 8 is a perspective view showing a modification.
Figure 11:
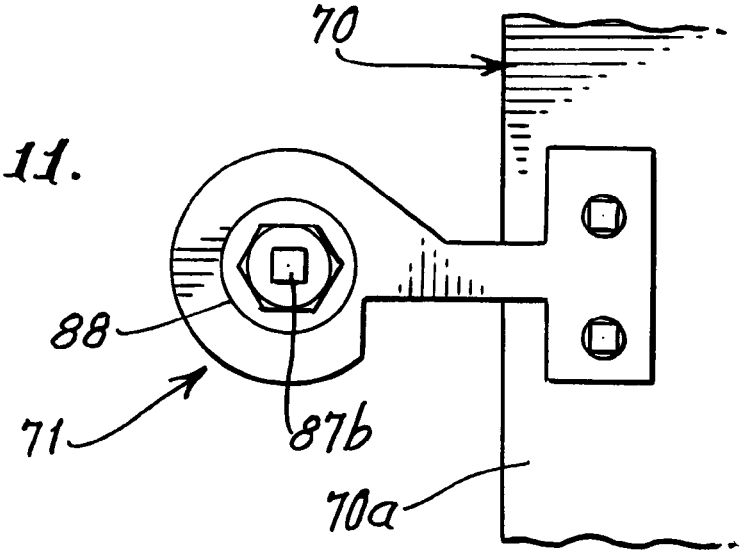
FIG. 11 is a side elevation taken on lines 11—11 of FIG. 9.

The invention also enables linkage extension, to further separate the pedal unit and the cymbals stand, and to substantial distances, for example to accommodate a bass drum 70 in space 34, for example in the manner as shown in FIG. 8. Drum 70 is supported on the floor. As seen, support structure is provided to support a mid portion of the rotary linkage, as between the pedal unit and the cymbals stand. In that example, the support structure is associated with the large bass drum 70, and may include a clamp or clamps 71 removably attached to the drum rim 70*a* as at two locations as shown. To this end, the linkage may then include multiple links, including a first or mid link 26*a* supported at clamps 71; a second link 26*b* end-connected as via U-joints 56 and 57 between the foot pedal axle and the left end of link 26*a*; a third link 26 end-connected as via U-joints 56*a* and 57*a* between the connector unit (axle and sprocket) at the frame 18, and the right end of link 26*a*. The universal joints enable wide angular orientation of the rotary link 26*b* and 26*c* to transmit rotary drive to the level of the middle link, that has clamp-connection to portions of the drum rim that extend in planes generally normal to the axis of link 26*a*, for optimum clamp connection. Such drive also by-passes a pedal unit 90 used for beating the drum. See FIG. 8.

The described structure also enables connection to the rim at either side of the drum, as may be needed for a selected percussion instrument playing set-up.

Figure 9:
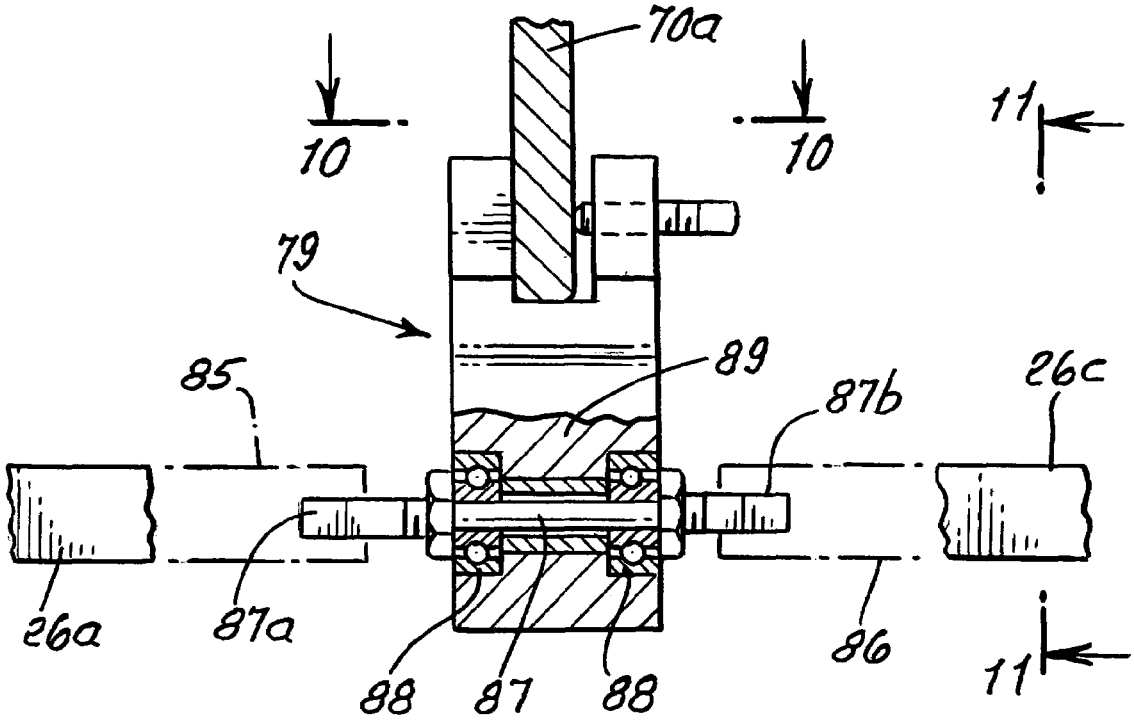
FIG. 9 is an enlarged section taken on lines 9—9 of FIG. 8.
Figure 10:
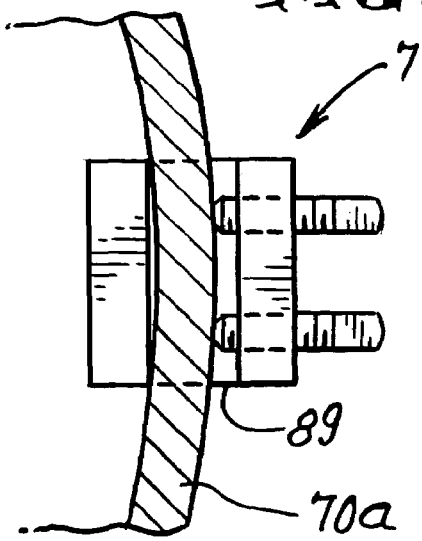
FIG. 10 is a side elevation taken on lines 10—10 of FIG. 9.

FIG. 9 shows a connection between links 26*a* and 26*c* to include universal joints 85 and 86, an axle 87 having polygonal (for example square) ends 87*a* and 87*b* attached to the joints, and bearings 88 in or on a support block 89, to support axle 87. Block 89 supports clamp 71.

The following elements are also shown in the drawings:

11*a* is a stand outer sleeve
12*a* is a disc attachment
26*a* is a linkage component
26*b* is a linkage component
26*c* is a linkage component
56*a* is a linkage joint
57*a* is a linkage joint
58*a* is a linkage component
70*a* is a drum rim
87*a* is an axle end
87*b* is an axle end.

I claim:

1. For use in actuating a cymbal or the like, there being an upright support stand and an upright rod associated with the stand and attached to the cymbal to move it vertically, and there being a foot activated pedal unit remote from the stand, the combination comprising a) a first frame associated with the stand, and a connector unit associated with the frame, said rod connected with said connector unit to be moved longitudinally upwardly and downwardly by said unit, b) an elongated rotary linkage extending laterally between said pedal unit and said connector unit, the connector unit configured to transfer and convert rotary motion transmitted by the linkage to longitudinal motion transferred to said rod, c) there being support structure supporting a portion of said linkage, at a location between said first frame and said pedal unit, d) and wherein said support structure is defined by a drum rim.

2. The combination of claim 1 wherein said linkage includes multiple links a first link supported by said support structure.

3. The combination of claim 2 wherein said multiple links include a second link connected between said pedal unit and said first link.

4. The combination of claim 3 wherein said multiple links include a third link connected between said connector unit and said first link.

5. The combination of claim 3 including a universal joint connected between said first and second links.

6. The combination of claim 5 including another universal joint connected between said second and third links.

7. In operation of a cymbals or the like, there being an upright support stand and an upright rod associated with the stand and attached to a cymbals disc to move it vertically, and there being a foot activated pedal unit remote from the stand, the method that includes:

i) providing and employing a least one rotary universal joint in series with the linkage to compensate for misalignment between the pedal unit and a connector unit that converts rotary motion of the linkage or rod endwise movement, ii) providing a percussion instrument in space between the pedal unit and said connector unit, the linkage by-passing a beater for said percussion instrument, iii) and wherein said percussion instrument is a bass drum having a rim on which said linkage is supported.

8. For use in actuating a cymbal or the like, there being an upright support stand and an upright rod associated with the stand and attached to the cymbal to move it vertically, and there being a foot activated pedal unit remote from the stand, the combination comprising a) a first frame associated with the stand, and a connector unit associated with the frame, said rod connected with said connector unit to be moved longitudinally upwardly and downwardly by said unit, b) an elongated rotary linkage extending laterally between said pedal unit and said connector unit, the connector unit configured to transfer and convert rotary motion transmitted by the linkage to longitudinal motion transferred to said rod, c) a return spring acting via the rotary linkage to yieldably resist downward movement of the pedal at the pedal unit, d) and wherein said linkage include an elevated middle link supported by a drum rim, and two additional links, one of which is connected between the pedal unit and said middle link, and the other of which is connected between said middle link and said connector unit.

* * * * *